US008879940B2

(12) United States Patent
Kasamatsu et al.

(10) Patent No.: US 8,879,940 B2
(45) Date of Patent: Nov. 4, 2014

(54) IMAGE FORMING APPARATUS WHICH CONTROLS FLUCTUATION OF FIXING ROLLERS BASED ON A DETECTED INTERVAL BETWEEN TRANSFERRED SHEETS OF RECORDING MEDIA

(75) Inventors: Toru Kasamatsu, Aichi (JP); Takayuki Ueda, Tokyo (JP); Yoshihito Sasamoto, Tokyo (JP); Eiji Nishikawa, Tokyo (JP); Satoshi Miyajima, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 218 days.

(21) Appl. No.: 13/478,467

(22) Filed: May 23, 2012

(65) Prior Publication Data

US 2012/0301170 A1 Nov. 29, 2012

(30) Foreign Application Priority Data

May 26, 2011 (JP) ..... 2011-118006

(51) Int. Cl.
*G03G 15/20* (2006.01)
*G03G 15/00* (2006.01)

(52) U.S. Cl.
CPC ..... *G03G 15/2017* (2013.01); *G03G 15/657* (2013.01); *G03G 15/2028* (2013.01); *G03G 15/6567* (2013.01)
USPC ..... 399/68; 399/322

(58) Field of Classification Search
USPC ..... 399/68, 322
See application file for complete search history.

(56) References Cited

U.S. PATENT DOCUMENTS

| | | | | |
|---|---|---|---|---|
| 5,640,231 | A * | 6/1997 | Mitsui et al. | 399/335 |
| 7,848,696 | B2 * | 12/2010 | Peng et al. | 399/395 |
| 2008/0253785 | A1 * | 10/2008 | Yamamoto et al. | 399/68 |
| 2011/0020033 | A1 * | 1/2011 | Nagase et al. | 399/122 |

FOREIGN PATENT DOCUMENTS

| | | | |
|---|---|---|---|
| JP | 2004-287317 | * | 10/2004 |
| JP | 2004-287317 | A | 10/2004 |

* cited by examiner

*Primary Examiner* — Sandra Brase
(74) *Attorney, Agent, or Firm* — Holtz, Holtz, Goodman & Chick PC

(57) ABSTRACT

An image forming apparatus includes an adjustment unit that adjusts an image transfer position of the sheet of paper along a main scanning direction that is orthogonal to a transporting direction of the sheet of paper, a fixing unit that fixes on the sheet of paper an toner image using fixing rollers and performs a fluctuation of the fixing roller to the main scanning direction, a detection unit that detects whether or not the fixing rollers of the fixing unit nip the sheet of paper, and a controller. The controller controls the fixing unit to perform the fluctuation of the fixing rollers when determining that the fixing rollers of the fixing unit do not nip the sheet of paper based on a detection result of the detection unit.

6 Claims, 8 Drawing Sheets

IMAGE FORMING APPARATUS WHICH CONTROLS FLUCTUATION OF FIXING ROLLERS BASED ON A DETECTED INTERVAL BETWEEN TRANSFERRED SHEETS OF RECORDING MEDIA

CROSS REFERENCES TO RELATED APPLICATIONS

The present invention contains subject matter related to Japanese Patent Application JP 2011-118006 filed in the Japanese Patent Office on May 26, 2011, the entire contents of which being incorporated herein by reference.

BACKGROUND OF THE INVENTION

1. Field of the Invention

The present invention relates to an image forming apparatus that forms an image on a sheet of paper which has been transported.

2. Description of Related Art

An image forming apparatus equipped with multiple functions, which is simultaneously provided with various functions such as a printer, scanner, a copy machine and a facsimile, has been widely used in recent years. In such an image forming apparatus, a sheet of paper may be deflected to an offset position while the sheet of paper is transported to a transferring unit which transfers an image because of mechanical factors or the like in the apparatus. Thus, a line sensor which detects a positional deflection of the sheet of paper and/or registration rollers which correct deviation of the sheet of paper are/is provided upstream from the transferring unit in the transporting path of the sheet of paper. By detecting a side end of the sheet of transporting paper with the line sensor and by moving the sheet of paper by a difference between the detected side end of the sheet of paper and a position corresponding to an end of an image forming position along a width direction of the sheet of paper, a deviation of the sheet of paper along the width direction of the sheet of paper, namely, a main scanning direction of the sheet of paper on which the line sensor mainly scans is corrected.

Sheets of paper which have been met on the image forming position along the main scanning direction by the registration rollers or sheets of paper which have been fed from the same feeding tray pass through the same location in a pressure roller and a fixing belt (hereinafter, referred to as "fixing rollers") which constitute a fixing unit so that any scratches may occur on the fixing rollers. Particularly, when using a sheet or sheets of stiff thick paper, the pressure roller or the like is subject to any scratches by means an edge or edges of the sheet or sheets of stiff thick paper. In order to prevent the scratches from occurring in the fixing rollers when the sheets of paper pass through the same location therein, a process of allowing the fixing unit including the fixing rollers to fluctuate along a direction which is orthogonal to a transporting direction of the sheet of paper has been performed.

For example, Japanese Patent Application Publication No. 2004-287317 discloses an image forming apparatus which is provided with moving means for moving the fixing unit along a width direction of the sheet of paper, which is orthogonal to a transporting direction of the sheet of paper. In such an image forming apparatus, the fixing unit can be moved along the width direction of the sheet of paper so that it is possible to prevent the sheets of paper from passing through the same location in the fixing rollers, which allows any occurrence of the scratches a the fixing unit to be avoided.

SUMMARY OF THE INVENTION

However, the past image forming apparatus, which has been disclosed in Japanese Patent Application Publication No. 2004-287317, has a configuration such that when performing a fixing processing on non-toner image transferred on the sheet of paper, the fixing rollers fluctuate along the main scanning direction. Therefore, the sheets of paper, a position of the main scanning direction of each of which is adjusted by registration rollers so as to be met on the image forming position, have been ejected onto a paper ejection tray with them being positionally deflected along the main scanning direction. This causes the sheets of paper to be stacked on the paper ejection tray with them being irregularly aligned along the main scanning direction.

This invention solves the above-mentioned problem and has an object to provide the image forming apparatus which can stack the sheets of paper on the paper ejection tray without being irregularly aligned along the main scanning direction.

To achieve the above-mentioned object, an image forming apparatus that forms an image on a sheet of paper, reflecting one aspect of the present invention, contains an adjustment unit that adjusts an image transfer position of the sheet of paper along a main scanning direction that is orthogonal to a transporting direction of the sheet of paper, a transferring unit that transfers a toner image at the image transfer position on the sheet of paper, the image transfer position of which is adjusted by the adjustment unit, a fixing unit that fixes on the sheet of paper the toner image transferred on the sheet of paper by the transferring unit using fixing rollers to heat and press the toner image on the sheet of paper and performs a fluctuation of the fixing rollers along the main scanning direction, a detection unit that detects whether or not the fixing rollers of the fixing unit nip the sheet of paper, and a control unit that controls the fixing unit to perform the fluctuation of the fixing rollers when determining that the fixing rollers of the fixing unit do not nip the sheet of paper based on a detection result of the detection unit.

It is desirable to provide the image forming apparatus further comprising an operation unit that sets the fixing unit so as to perform the fluctuation of the fixing rollers when the fixing rollers of the fixing unit do not nip the sheet of paper or to perform the fluctuation of the fixing rollers regardless of whether or not the fixing rollers of the fixing unit nip the sheet of paper.

It is desirable to provide the image forming apparatus wherein the control unit determines whether or not an interval between the sheets of transported paper is longer than a reference interval which has been previously set; if the interval between the sheets of transported paper is longer than the reference interval, the control unit controls the fixing unit to perform the fluctuation of the fixing rollers when the fixing rollers of the fixing unit do not nip the sheet of paper; and if the interval between the sheets of transported paper is not longer than the reference interval, the control unit controls the fixing unit to perform the fluctuation of the fixing rollers regardless of whether or not the fixing rollers of the fixing unit nip the sheet of paper.

It is desirable to provide the image forming apparatus wherein the control unit controls the fixing unit to perform the fluctuation of the fixing rollers at a first speed when an interval between the sheets of transported paper is not longer than the reference interval, and the control unit controls the fixing unit to perform the fluctuation of the fixing rollers at a second speed which is faster than the first speed when the interval between the sheets transported paper is longer than the reference interval.

It is desirable to provide the image forming apparatus wherein the adjustment unit adjusts the image transfer position based on a center of a transporting path of the sheet of paper.

It is desirable to provide the image forming apparatus wherein the adjustment unit adjusts the image transfer position based on one side of an image forming position.

It is desirable to provide the image forming apparatus further comprising an image forming unit, wherein the detection unit contains a first sensor that detects each of the sheets of paper transported from the image forming unit, the first sensor being positioned at an entrance side of the fixing unit, and a second sensor that detects each of the sheets of paper on which the fixing unit performs fixing processing, the second sensor being positioned at an exit side of the fixing unit, and wherein the control unit controls the fixing unit to perform the fluctuation of the fixing rollers when the first and second sensors do not detect any of the sheets of paper.

On the embodiment of the image forming apparatus according to the invention, the adjustment unit adjusts the sheet of paper fed from the feeding tray so that the sheet of paper meets an image transfer position thereof along the main scanning direction of the sheet of paper. The transferring unit then transfers the toner image at the image transfer position on the sheet of paper, the image transfer position of which is adjusted by the adjustment unit. The sheet of paper on which the toner image is transferred is then transported to the fixing unit. The fixing unit fixes on the sheet of paper a non-toner image transferred on the sheet of paper by heating and pressing the non-toner image on the sheet of paper.

In order to prevent the scratches from occurring in the fixing rollers when the sheets of paper pass through the same location therein, the fixing unit further performs a fluctuation of the fixing rollers along the main scanning direction with the sheet of paper being nipped with the fixing rollers. In this invention, when the control unit determines that the fixing rollers of the fixing unit do not nip the sheet of paper based on a detection result of the detection unit, the fixing unit performs the fluctuation of the fixing rollers along the main scanning direction.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

The following will describe embodiments of an image forming apparatus relating to the invention with reference to drawings.

First Embodiment

Figure 1:
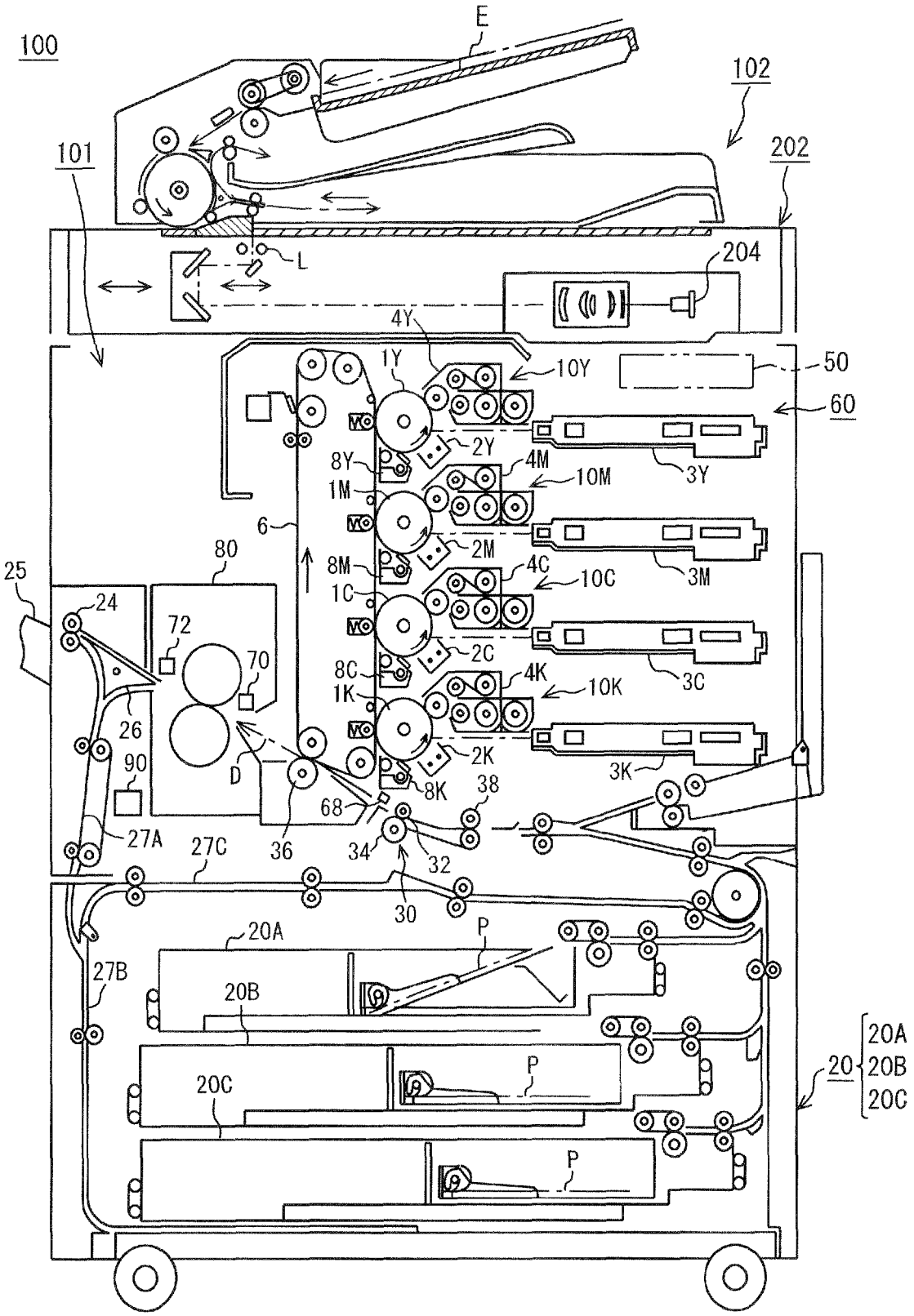
FIG. 1 is a drawing showing a configuration example of an image forming apparatus according to a first embodiment of this invention.

Configuration Example of Image Forming Apparatus According to First Embodiment FIG. 1 schematically shows a configuration example of the image forming apparatus 100 according to a first embodiment of this invention. The image forming apparatus 100 according to a first embodiment of this invention carries out a fluctuation of a fixing unit 80 (herein after, referred to as "fixing unit fluctuation operation.") along a direction (herein after, referred to as "main scanning direction D2", see FIG. 4) which is orthogonal to a transporting direction D1 of the sheet of paper P, if the fixing rollers do not nip the sheet of paper P when it is shown as a result of the detection of the sheet of paper that an entrance sensor 70 for the sheet of paper, which is positioned at an entrance of the fixing unit, and an exit sensor 72 for the sheet of paper, which is positioned at an exit of the fixing unit, are both turned off.

The image forming apparatus 100 is referred to as "an image forming apparatus of tandem type" as shown in FIG. 1. The image forming apparatus 100 contains a main body 101 of the image forming apparatus and an automatic document feeder 102 mounted on the main body 101. The automatic document feeder 102 feeds the documents P, which are mounted on the document mounter, on a one-by-one basis to the main body 101 of the image forming apparatus with them being separated.

The main body 101 of the image forming apparatus contains a document-reading unit 202, a control unit 50, image forming units 10Y, 10M, 10C and 10K, an intermediate transfer belt 6, secondary transfer rollers 36, a feeder 20, the fixing unit (portion) 80, a fluctuation mechanism 90, the entrance sensor 70 for the sheet of paper, and the exit sensor 72 for the sheet of paper. It is to be noted that the image forming units 10Y, 10M, 10C and 10K, the intermediate transfer belt 6 and the secondary transfer rollers 36 constitute an example of an image forming unit 60.

The document-reading unit 202 irradiates light onto an image of the document E at a document image reading position through a lamp L and receives light reflected thereby to focus on an image pickup device 204 such as charge-couple device (CCD) through a mirror unit or the like. The image pickup device 204 receives the light and performs photoelectric conversion thereon to obtain an electric image signal which is output to the controller 50. The controller 50 performs various kinds of processing such as A/D conversion, shading compensation, compression and the like on the image signal to generate any image data.

The image forming unit 10Y contains a charging portion 2Y, an exposing portion 3Y, a developing portion 4Y, a photosensitive drum 1Y and a cleaning portion 8Y. The charging portion 2Y charges a static charge uniformly around a surface of the photosensitive drum 1Y. The exposing portion 3Y is composed of a laser source, polygon mirror, plural lenses and the like, which are not shown. The exposing portion 3Y scans a surface of the photosensitive drum 1Y using laser beam based on the image data received from the controller 50 to form a latent image. The developing portion 4Y develops the latent image on a surface of the photosensitive drum 1Y by using yellow toner Y, thereby forming a yellow toner image (Y). The cleaning portion 8Y cleans the toner leaved on the surface of the photosensitive drum 1Y which has finished transferring the toner image.

Other image forming units 10M, 10C and 10K have respectively the same function and configuration as those of the image forming unit 10Y. The developing portions 4M, 4C and 4K develop the latent images on the photosensitive drums 1M, 1C and 1K using magenta toner M, cyan toner C and black toner BK respectively to affix them to form the latent images on the photosensitive drums 1M, 1C and 1K as their toner images. Respective toner images formed on the photosensitive drums 1Y, 1M, 1C and 1K are transferred to the endless intermediate transfer belt 6 so that the images are overlapped at their predetermined image forming locations, thereby forming a color image on the intermediate transfer belt 6.

The feeder 20 is provided with plural feeding trays 20A, 20B and 20C. The feeder 20 sends the sheet of paper P, which is selected by a user, from any of the feeding trays 20A, 20B and 20C by using the conveyor rollers and transports it to registration rollers 30 through loop rollers 38.

The registration rollers 30 contain a pair of rollers 32, and are positioned upstream from secondary transfer rollers 36 on a transporting path. The registration rollers 30 perform a positional deflection correction of the sheet of paper P by thrusting a forward end of the sheet of paper P against them so that the sheet of paper P is looped under the transporting control of the loop rollers 38 which are positioned upstream from the registration rollers 30 along the transporting direction D1. The registration rollers 30 fluctuate along the main scanning direction D2 based on a detection result of a deviation detection sensor 68, thereby correcting the deviation of the sheet of paper P. It is to be rioted that the registration rollers 30 constitute the adjustment unit.

The sheet of paper F, a deviation of which has been corrected along the main scanning direction D2 by the registration rollers 30, is transported to the secondary transfer portion at a fixed timing. The sheet of paper P is brought into contact with the intermediate transfer belt 6 and a color image formed by overlapping respective toner images on the intermediate transfer belt 6 is transferred to the sheet of paper P. The sheet of paper P to which the color image is transferred is transported to the fixing unit 80 by the secondary transfer rollers 36 or the like.

The fixing unit 80 contains a heater and the like. The fixing unit 80 fixes the color image (non-toner image) on the sheet of paper P by applying pressure to the sheet of paper P and/or heating the same. The fixing unit 80 fluctuates at a constant speed along the main scanning direction D2 by driving the fluctuation mechanism 90 during the image forming process. In this embodiment, the fixing unit 80 fluctuates when the sheet of paper P is not fixed. The fixed sheet of paper P is ejected by paper ejection rollers 24 to a paper ejection tray 25. The sheets of ejected paper are successively stacked. It is to be noted that the fixing unit 80 and the fluctuation mechanism 90 will be described later.

The entrance sensor 70 for the sheet of paper is positioned at a side of an entrance 85*a* in a case 85 of the fixing unit 80 (see FIG. 3) and detects whether or not the sheet of paper P on which an image forming unit 60 transfers the toner image passes through it. The exit sensor 72 for the sheet of paper is positioned at a side of an exit 85*b* in the case 85 of the fixing unit 80 (see FIG. 3) and detects whether or not the sheet of paper P which the fixing unit 80 fixes passes through it. It is determined that when both of the entrance sensor 70 for the sheet of paper and the exit sensor 72 for the sheet, of paper are turned on, the fixing rollers of the fixing unit 80 nip the sheet of paper P. Accordingly, it is possible to surely determine whether or not the fixing rollers in the fixing unit 80 nip the sheet of paper P. It is to be noted that the entrance sensor 70 for the sheet of paper constitutes a first sensor and the exit sensor 72 for the sheet of paper constitutes a second sensor.

When images are formed on both sides of the sheet of paper P, the sheet of paper P, on a surface of which the image has already been formed, is transported into a loop path 27A via diverging paths 26, inverted in the inverting portion 27B and then, transported to the secondary transfer portion again via a re-feeding path 27C. In the secondary transfer portion, the other color image is transferred to a back surface of the sheet of paper P and then, ejected to the paper ejection tray 25 via the fixing unit 80.

Figure 2:
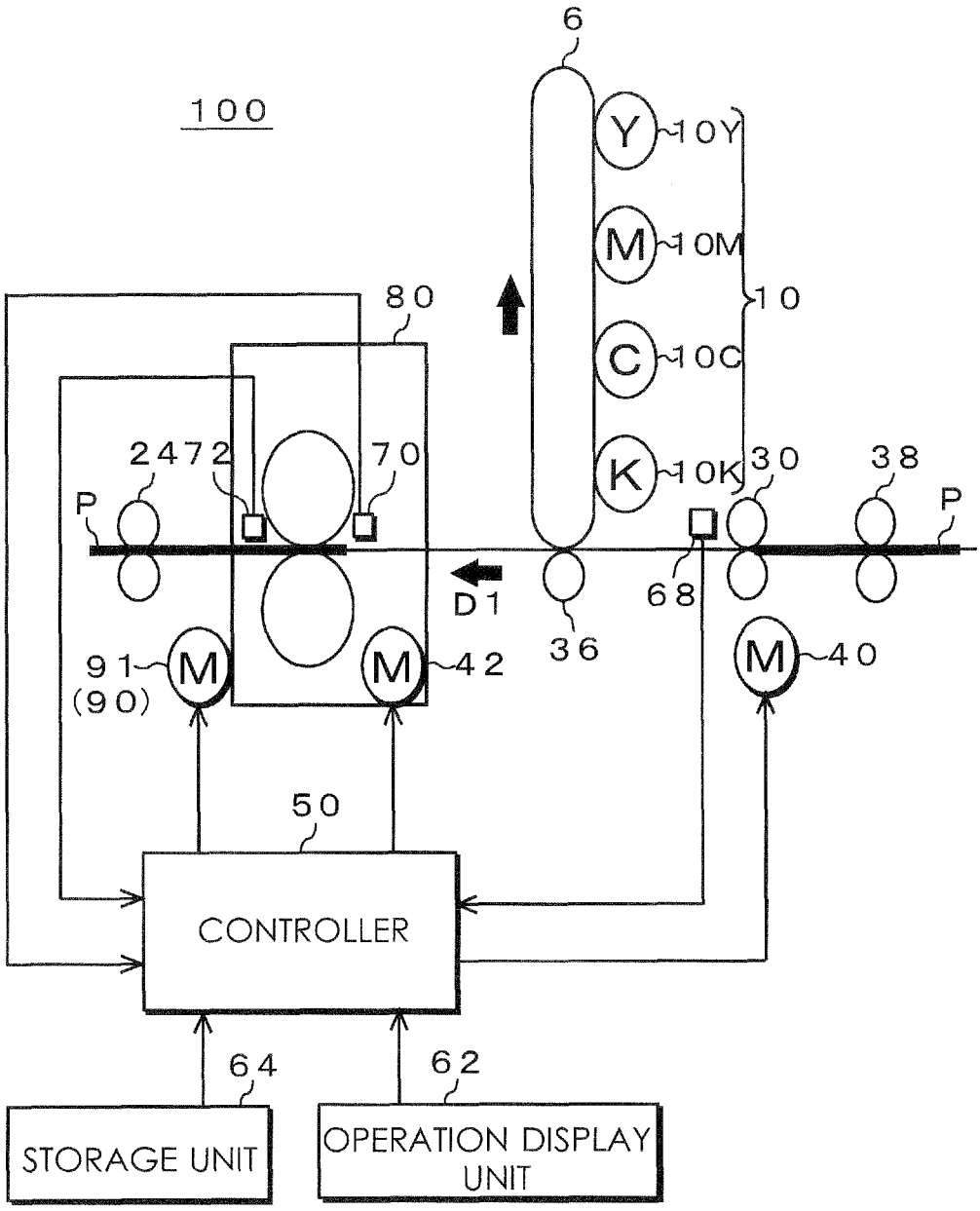
FIG. 2 is a block diagram of the image forming apparatus illustrating a configuration example thereof.

Configuration Example of Image Forming Apparatus According to First Embodiment FIG. 2 illustrates a configuration example of the image forming apparatus 100. As shown in FIG. 2, the image forming apparatus 100 contains a controller 50 controlling an operation of whole of the image forming apparatus 100. The controller 50 includes a central processing unit (CPU), a read only memory (ROM), a random access memory (PAM) and the like. CPU performs an image forming process, the fluctuation controls of the fixing unit 80 and/or the like by reading any programs stored in ROM and extracting the programs to execute them.

The controller 50 connects an operation display unit 62, a storage unit 64, a fluctuation motor 40 for the registration rollers, a fixing unit driving motor 42, a fixing unit fluctuation motor 91, the deviation detection sensor 68, the entrance sensor 70 for the sheet of paper and the exit sensor 72 for the sheet of paper, respectively.

The operation display unit 62 is composed of, for example, a touch panel of capacitive sensing system or resistive film system and is provided on an upper front par the main body 101 of the image forming apparatus 100. The operation display unit 62 detects input information based on any input operations by a user and supplies an operation signal to the controller 50. For example, the operation display unit 62 receives any information on various kinds of conditions of image forming processing and receives any information on whether or not the fluctuation operation of the fixing unit 80 is set to supply the operation signals based on these pieces of input information to the controller 50.

The storage unit 64 is composed of, for example, a semiconductor memory, a hard disk drive (HDD) and the like. The storage unit 64 stores, for example, threshold values Th used when performing the fluctuation of the fixing unit and a table in which intervals D between the sheets of paper based on the sizes and/or species of the sheets of paper are listed.

The entrance sensor 70 for the sheet of paper is composed of, for example, a sensor of reflection type or transmission type. The entrance sensor 70 for the sheet of paper detects the sheet of paper P transported from the entrance 85*a* of the fixing unit 80. For example, the entrance sensor 70 for the sheet of paper supplies to the controller 50 an ON signal indicating that the sensor detects the sheet of paper P for a period of time from a point of time when a forward end of the sheet of paper P passes through it to a point of time when a rear end of the sheet of paper P passes through it.

The exit sensor 72 for the sheet of paper is composed of, for example, a sensor of reflection type or transmission type. The exit sensor 72 for the sheet of paper detects the sheet of paper P fixed in and transported from the fixing unit 80. For example, the exit sensor 72 for the sheet of paper supplies to the controller 50 an ON signal indicating that the sensor detects the sheet of paper for a period of time from a point of time when a forward end of the sheet of paper P passes through it to a point of time when a rear end of the sheet of paper P passes through it.

The deviation detection sensor 68 is composed of, for example, a line sensor. The deviation detection sensor 68 is positioned downstream from the registration rollers 30 along the transporting direction D1 and is positioned so that it is parallel with the main scanning direction D2. The deviation detection sensor 68 detects, for example, a side end of the sheet of paper P nipped by the registration rollers 30 and supplies any positional information of the side end of the sheet of paper P obtained by this detection to the controller 50 as a detected signal.

The fluctuation motor 40 for the registration rollers is composed of, for example, a stepping motor and the like. The fluctuation motor 40 for the registration rollers drives on the basis of the driving signal received from the controller 50 to move the registration rollers 30 to the main scanning direction D2 via gears and the like. This enables the sheet of paper P to be moved to a normal image forming position, thereby correcting the deviation the sheet of paper P.

The fixing unit driving motor 42 is composed of, for example, a stepping motor or the like. The fixing unit driving motor 42 drives based on a driving signal received from the controller 50 to rotate, for example, a supporting pressure roller 81 of the fixing unit 80. This enables the fixing belt 84 and the like to be driven, thereby transporting the sheet of paper P with it being heated and pressured.

The fixing unit fluctuation motor 91 is composed of, for example, a stepping motor or the like. The fixing unit fluctuation motor 91 drives based on a driving signal received from the controller 50 to move the fixing unit 80 back and forth along the main scanning direction D2 through driving gear series composed of the gears 92, 93 (see FIG. 4). This can prevent the sheet of paper P from passing through the same location in an outside pressure roller 83 and the fixing belt 84.

The controller 50 calculates a difference between the positional information of the side end of the sheet of paper P received from the deviation detection sensor 68 and any information on a side end of a previously set image forming position, which corresponds to the side end of the sheet of paper P. The controller 50 then controls the registration rollers 30 to move the sheet of paper P to the normal image forming position by moving the registration rollers 30 along the main scanning direction D2 by the difference with the sheet of paper P being nipped. It is to be noted that the image forming position in this embodiment indicates a position where an image is transferred by the image forming unit 60, which is previously set based on a case where the sheet of paper P is transported on the basis of a center of the transporting path. Of course, the registration correction may be performed on the basis of one side of the image forming position.

The controller 50 controls the fixing unit fluctuation motor 91 to drive and perform the fixing unit fluctuation operation when the sheet of paper P is not nipped between the supporting pressure roller 81 and the outside pressure roller 83. For example, when both of the entrance sensor 70 for the sheet of paper and the exit sensor 72 for the sheet of paper are turned off, it is determined that the sheet of paper P is not fixed in the fixing unit 80, and the controller 50 controls the fixing unit fluctuation motor 91 to drive and perform the fixing unit, fluctuation operation. As a fluctuation speed of the fixing unit 80, a slow speed is adopted so that it has not any influence on the fixing processing. For example, it is about several hundreds μm/s. On the other hand, when both of the entrance sensor 70 for the sheet of paper and the exit sensor 72 for the sheet of paper are turned on or either of them is turned on, it is determined that the sheet of paper P is fixed in the fixing unit 80, and the controller 50 stop the fixing unit fluctuation operation.

Configuration Example of Fixing Unit

Figure 3:
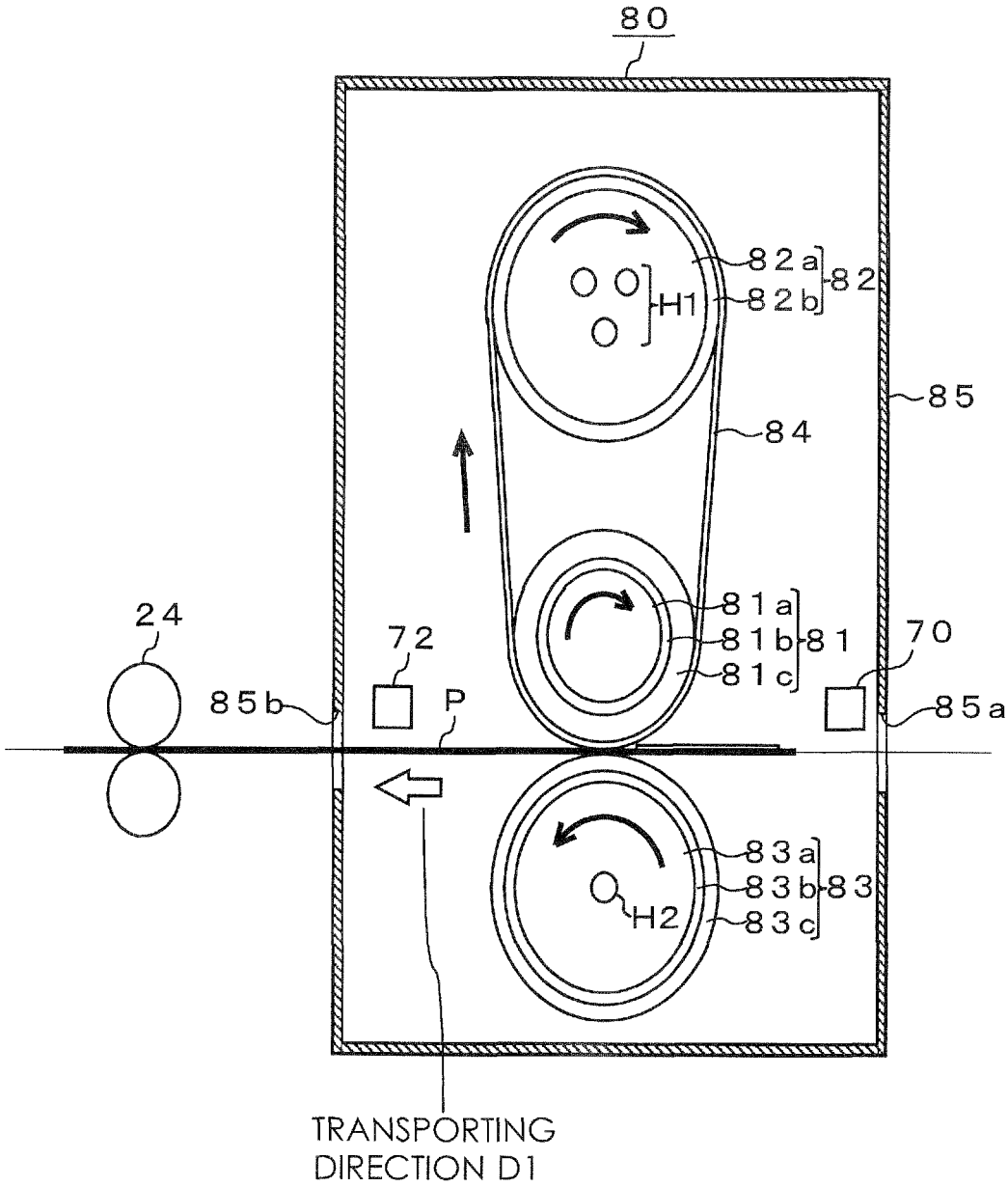
FIG. 3 is a sectional view of a fixing unit showing configuration example thereof.

FIG. 3 schematically shows a configuration example of the fixing unit 80. As shown in FIG. 3, the fixing unit 80 has a case 85 with a shape of a rectangular parallelepiped. In the case 85, the supporting pressure roller 81, a supporting heat roller 82, the outside pressure roller 83 and the fixing belt 84 are positioned.

The supporting heat roller 82 comes into contact with an inner circumference of the fixing belt 84 and is positioned above the supporting pressure roller 81 away from the supporting pressure roller 81 predetermined distance. The supporting heat roller 82 is composed of a cylindrical pipe 82*a* made of aluminum alloy and the like as a base thereof, and a coating layer 82*b* provided around an outer circumference of the pipe 82*a*. The supporting heat roller 82 includes a heater such as a halogen lamp and a xenon lamp. The heater H1 heats the fixing belt 84 and the like at a predetermined temperature.

The supporting pressure roller 81 comes into contact with the inner circumference of the fixing belt 84 and is positioned so that it is opposed to the outside pressure roller 83. The supporting pressure roller 81 is composed of a cylindrical metal pipe 81*a* made of, for example, steel materials, a silicone rubber layer 81*b* provided around an outer circumference of the metal pipe 81*a* and a perfluoroalkoxy (PFA) tube 81*c* provided around an outer circumference of the silicone rubber layer 81*b*.

The outside pressure roller 83 is positioned so that it is opposed to the supporting pressure roller 81. The outside pressure roller 83 is composed of a cylindrical metal pipe 83*a* made of, for example, aluminum alloy, a silicone rubber layer 83*h* provided around an outer circumference of the metal pipe 83*a* and a released layer 83*c* using PEA tube provided around an outer circumference of the silicone rubber layer 83*h*. The outside pressure roller 83 includes heater H2 such as a halogen lamp and a xenon lamp. The heater H2 heats the outside pressure roller 83 at a predetermined temperature.

The fixing belt 84 is an endless belt made of polyimide and the like and is stretched round the outer circumferences of the supporting pressure roller 81 and the supporting heat roller 82.

Under this configuration, when the fixing unit driving motor 42 drives to rotate the supporting pressure roller 81, the fixing belt 84 and the outside pressure roller 83 are driven so that the sheet of paper P on which the toner images of various colors are transferred in the secondary transfer unit is nipped between the supporting pressure roller 81 and the outside pressure roller 83 and it is pressed and heated. Such a pressing and heating process enables the non-toner images to be fixed on the sheet of paper P.

Configuration Example of Fluctuation Mechanism

Figure 4:
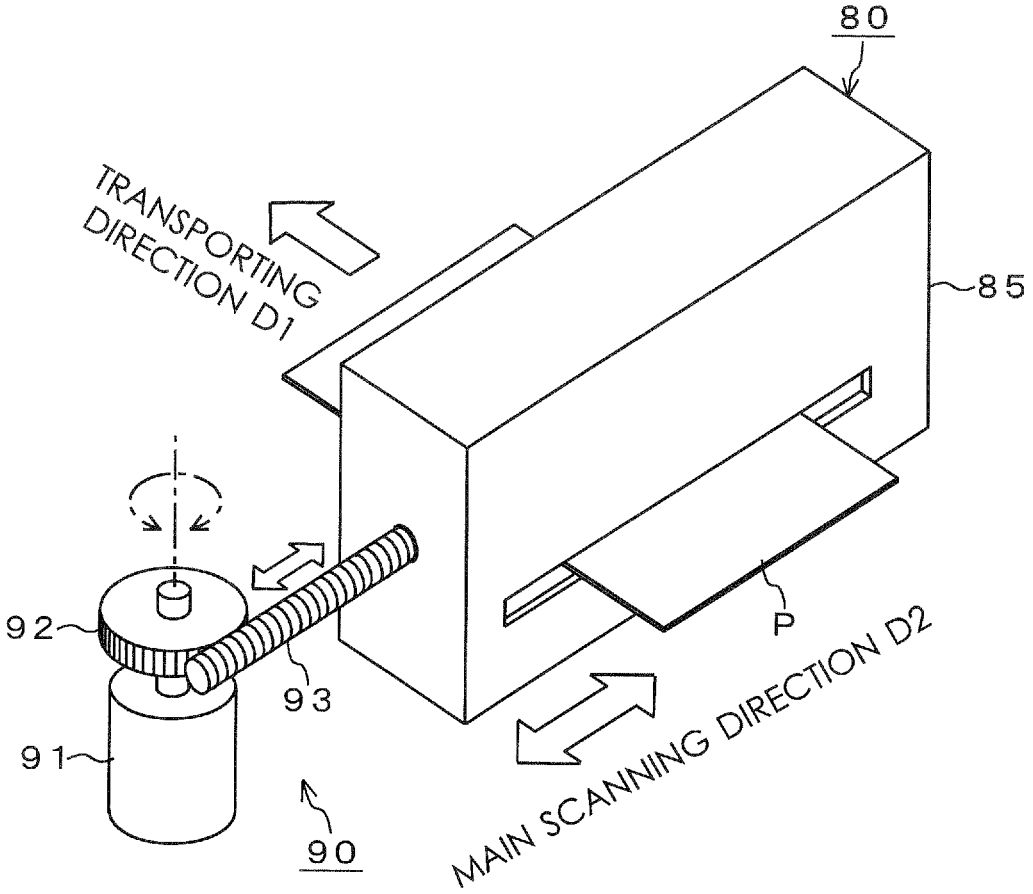
FIG. 4 is a diagram of a fluctuation mechanism illustrating a configuration example thereof.

FIG. 4 shows a configuration example of the fluctuation mechanism 90 that allows the fixing unit 80 to fluctuate. The fluctuation mechanism 90 is provided with the fixing unit fluctuation motor 91 and gears 92, 93. The fixing unit fluctuation motor 91 is composed of, for example, a stepping motor or the like and rotates and counter-rotates under the control of the controller 50, which will be described later. The gear 92 is attached to a rotation axis of the fixing unit fluctuation motor 91 and is engaged with the gear 93 so that channels on the circumference of the gear 92 are meshed with a screw portion of the gear 93. An end of the gear 93 is fixed on a side surface of the case 85.

When the fixing unit fluctuation motor 91 rotates and counter-rotates, the case 85 of the fixing unit 80 fluctuates back and forth along the main scanning direction D2 through a drive transmission system composed the gears 92, 93. Accordingly, the supporting pressure roller 81, the supporting heat roller 82, the outside pressure roller 83 and the fixing belt 84, which are included in the case 85, fluctuate back and forth along the main scanning direction D2 together with the case 85. It is to be noted that the fluctuation mechanism 90 is not limited to the above-mentioned configuration: For example, a cam may be used therefor to allow the fixing unit 80 to fluctuate along the main scanning direction D2.

Example of Operation of Image Forming Apparatus According to First Embodiment

Figure 5:
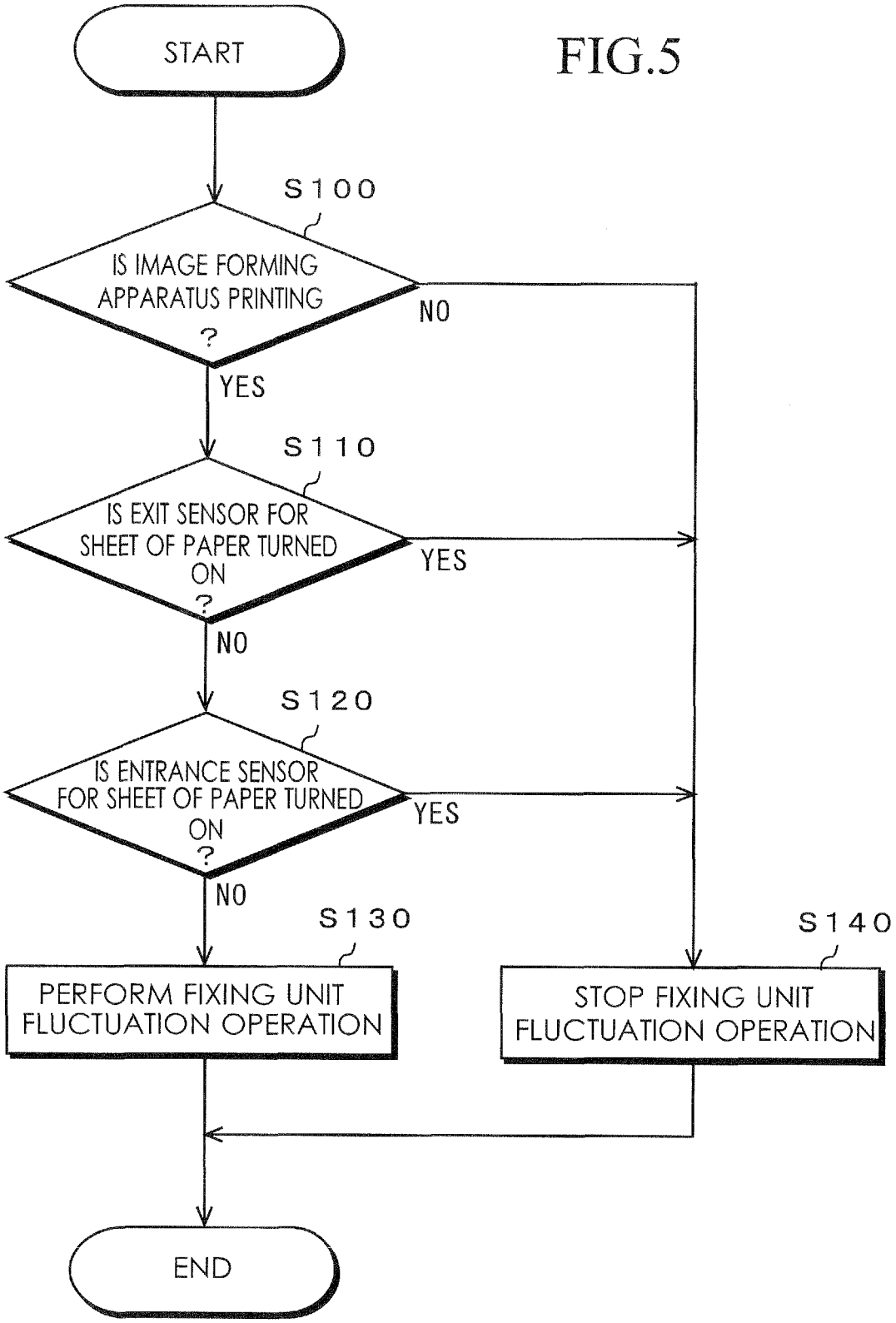
FIG. 5 is a flowchart showing an operation example of the image forming apparatus according to the first embodiment of this invention.

The following will describe an operation of the controller 50 in this embodiment of the image forming apparatus 100. FIG. 5 shows an operation example of the controller 50 in the image forming apparatus 100.

As shown in FIG. 5, at a step S100, the controller 50 determines if the image forming apparatus 100 is printing. For example, the controller 50 determines it based on a fact whether or not a user inputs a print job using the operation display unit 62 or a computer or the like the image forming apparatus 100 connects. If the controller 50 determines that the image forming apparatus 100 printing, then the controller 50 goes to a step S110. If not, then the controller 50 goes to a step S140.

At the step S110, the controller 50 determines if an output of the exit sensor 72 for the sheet of paper is turned on. If the exit sensor 72 for the sheet of paper is turned on, the controller 50 determines that the sheet of paper P is nipped between the supporting pressure roller 81 and the outside pressure roller 83 in the fixing unit 80, namely, the sheet of paper P is being fixed and goes to the step S140. On the other hand, if output of the exit sensor 72 for the sheet of paper is turned off, the controller 50 goes to a step S120. This is because if the sheet of paper P is not detected by the exit sensor 72 for the sheet of paper, there may be a possibility where the sheet of paper P which is being fixed does not reach the exit sensor 72 for the sheet of paper, or a next sheet of paper P reaches the entrance 85*a* of the fixing unit 80. Therefore, a detected result of the entrance sensor 70 for the sheet of paper should be also taken into consideration.

At the step S120, the controller 50 determines if an output of the entrance sensor 70 for the sheet of paper is turned on. If the entrance sensor 70 for the sheet of paper is turned on, the controller 50 determines that the sheet of paper P is nipped between the supporting pressure roller 81 and the outside pressure roller 83 in the fixing unit 80 and goes to the step S140. On the other hand, if output of the entrance sensor 70 for the sheet of paper is turned off, the controller 50 determines (or decides) that the sheet of paper P is not nipped between the supporting pressure roller 81 and the outside pressure roller 83 in the fixing unit 80 because the output of the exit sensor 72 for the sheet of paper is also turned off and goes to a step S130.

At the step S130, because the current sheet of paper P is not nipped between the supporting pressure roller 81 and the outside pressure roller 83 in the fixing unit 80, the controller 50 performs the fixing unit fluctuation operation. Specifically, the controller 50 supplies a driving signal to the fixing unit fluctuation motor 91 to be driven so that the fixing unit 80 fluctuates along the main scanning direction D2 at a constant speed.

On the other hand, if the image forming apparatus 100 is not printing and output of the entrance sensor 70 for the sheet of paper or the exit sensor 72 for the sheet of paper is turned on, the controller 50 stops the fixing unit fluctuation operation at the step S140. Further, if the output of the entrance sensor 70 for the sheet of paper or the exit sensor 72 for the sheet of paper is turned on after the fixing unit fluctuation operation has started at the step S130, the controller 50 stops the fixing unit fluctuation operation by stopping the driving of the fixing unit fluctuation motor 91.

As described above, according to the first embodiment of the image forming apparatus, since the fixing unit fluctuation operation is performed when the sheet of paper P is not nipped between the supporting pressure roller 81 and the outside pressure roller 83 in the fixing unit 80, the sheet of paper P is not moved along the main scanning direction D2 during the fixing processing. This enables the sheets of paper P, a side end of each of which is met to the image forming position along the main scanning direction D2 by the registration rollers 30, to be ejected into the paper-ejection tray 25 as they are. Accordingly, it is possible to stack the sheets of paper P on the paper-ejection tray 25 without being irregularly aligned along the main scanning direction D2. Since the fixing unit fluctuation operation is performed when the sheet of paper P is not nipped between the supporting pressure roller 81 and the outside pressure roller 83, it is possible to prevent the fixing rollers from being scratched when the sheets of paper P pass through the same location in the fixing rollers Second Embodiment The second embodiment is different from the first embodiment in that a fixing unit fluctuation operation A and a fixing unit fluctuation operation B can be chosen. It is to be noted that other components and operations of the image forming apparatus 100 in this embodiment are identical to those of the first embodiment so that the identical components are indicated by the same reference numbers, a detailed explanation of which will be omitted.

Configuration Example of Image Forming Apparatus According to Second Embodiment

The image forming apparatus 100 has two fixing unit fluctuation modes, a fixing unit fluctuation mode A and a fixing unit fluctuation mode B, for the fluctuation operation of the fixing unit 80. The fixing unit fluctuation mode A is a mode of operation in which the fixing unit fluctuation operation is performed when the sheet of paper P is not nipped between the supporting pressure roller 81 and the outside pressure roller 83. The fixing unit fluctuation mode B is a mode of operation in which the fixing unit fluctuation operation is performed during the image forming process regardless of whether or not the sheet of paper P is nipped between the supporting pressure roller 81 and the outside pressure roller 83.

Since in the fixing unit fluctuation mode A, the fixing unit fluctuation operation is not performed when the sheet of paper P is being fixed, the sheets of paper, a position of each of which has been corrected along the main scanning direction D2 by the registration rollers 30, can be ejected into the paper ejection tray 25 as they are. This enables the sheets of paper P to be stacked on the paper-ejection tray 25 without being irregularly aligned along the main scanning direction D2. On the other hand, since in the fixing unit fluctuation mode B, the fixing unit fluctuation operation is performed even when the sheet of paper P is being fixed, it is impossible to stack the sheets of paper P without being irregularly aligned along the main scanning direction D2 like that in the fixing unit fluctuation mode A. In the fixing unit fluctuation mode B, however, it is possible to prevent the scratch surely from occurring in the supporting pressure roller 81 and the outside pressure roller 83.

The operation display unit 62 displays an operation screen for choosing the fixing unit fluctuation mode between the fixing unit fluctuation mode A and the fixing unit fluctuation mode B. The operation display unit 62 supplies an operation signal corresponding to the fixing unit fluctuation mode chosen by the user to the controller 50. The controller 50 allows the fixing unit fluctuation mode A or the fixing unit fluctuation mode B to be performed based on the operation signal received form the operation display unit 62.

Furthermore, although it has been described in this embodiment that the user chooses the fixing unit fluctuation mode between the fixing unit fluctuation mode A and the fixing unit fluctuation mode B, the controller may automatically choose the fixing unit fluctuation mode between the fixing unit fluctuation mode A and the fixing unit fluctuation mode B. For example, the fixing unit fluctuation mode A may be normally performed but the fixing unit fluctuation mode B may be automatically changed at a point of time when printing of predetermined sheets of paper has been finished. This is because taking it into consideration that the fixing rollers of the fixing unit 80 are increasingly scratched as the printed sheets of paper are increased, in such a case, the change to the fixing unit fluctuation mode B is useful for preventing the scratch from occurring in the fixing rollers.

Operation Example of Image Forming Apparatus According to Second Embodiment

Figure 6:
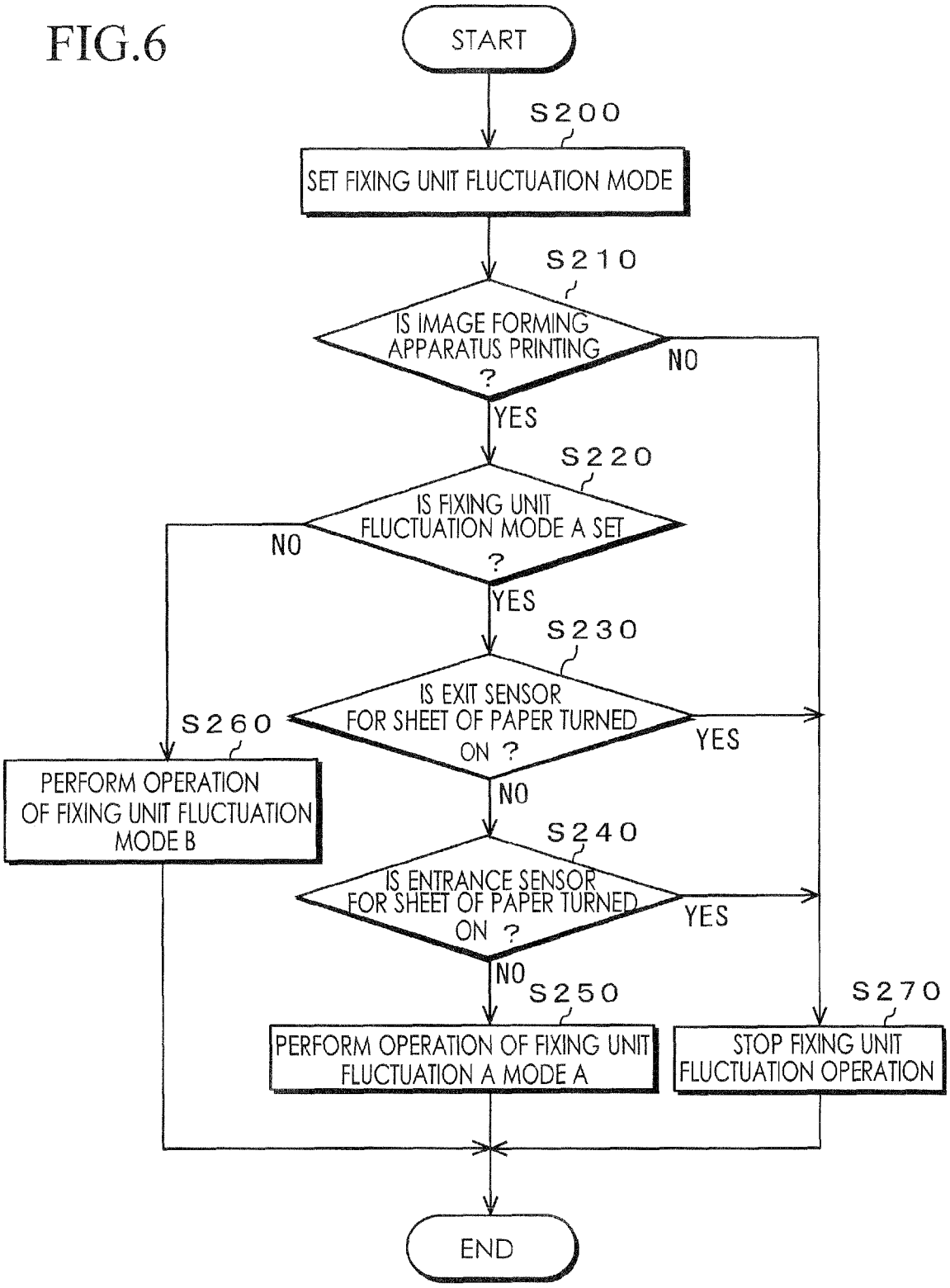
FIG. 6 is a flowchart showing an operation example of the image forming apparatus according to a second embodiment of this invention.

FIG. 6 is a flowchart showing an operation example of the image forming apparatus 100 according to a second embodiment of this invention. As shown in FIG. 6, at a step S200, the fixing unit fluctuation mode is set. When the user sets the fixing unit fluctuation mode A or the fixing unit fluctuation mode B based on his input operation on the operation screen of the operation display unit 62, the controller 50 obtains any mode-setting information based on the set fixing unit fluctuation mode A or B and goes to a step S210. At the step S210, the controller 50 determines if the image forming apparatus 100 is printing. If the controller 50 determines that the image forming apparatus 100 is printing, then the controller 50 goes to a step S220. If not, then the controller 50 goes to a step S270 where the fixing unit fluctuation operation of the fixing unit 80 is stopped.

At the step S220, the controller 50 determines if the set fixing unit fluctuation mode is the fixing unit fluctuation mode A based on the mode-setting information thus obtained. If the controller 50 determines that the set fixing unit fluctuation mode is the fixing unit fluctuation mode A, then the controller 50 goes to a step S230. If the controller 50 determines that the set fixing unit fluctuation mode is the fixing unit fluctuation mode B, then the controller 50 goes to a step S260.

At the step S230, the controller 50 determines if an output of the exit sensor 72 for the sheet of paper is turned on. If the exit sensor 72 for the sheet of paper is turned on, the controller 50 determines that the sheet of paper P is nipped between the supporting pressure roller 81 and the outside pressure roller 83 in the fixing unit 80 and goes to the step S270. At the step S270, the controller 50 allows the fixing unit fluctuation operation of the fixing unit 80 to be stopped. On the other hand, if the exit sensor 72 for the sheet of paper is turned off, the controller 50 goes to a step S240.

At the step S240, the controller 50 determines if an output of the entrance sensor 70 for the sheet of paper is turned on. If the entrance sensor 70 for the sheet of paper is turned on, the controller 50 determines that the sheet of paper P is nipped between the supporting pressure roller 81 and the outside pressure roller 83 in the fixing unit 80 and goes to the step S270. At the step S270, the control controller 50 allows the fixing unit fluctuation operation of the fixing unit 80 to be stopped. On the other hand, if output of the entrance sensor 70 for the sheet of paper is turned off, the controller 50 determines (or decides) that the sheet of paper P is not nipped between the supporting pressure roller 81 and the outside pressure roller 83 in the fixing unit 80 because the output of the exit sensor 72 for the sheet of paper is also turned off and goes to a step S250.

At the step S250, because the current sheet of paper P is not being fixed, the controller 50 performs an operation of the fixing unit fluctuation mode A. Specifically, the controller 50 supplies a driving signal to the fixing unit fluctuation motor 91 to be driven so that the fixing unit 80 fluctuates along the main scanning direction D2 at a constant speed.

On the other hand, if the controller 50 determines that the if fixing unit fluctuation mode B is set at the step S220, the controller 50 goes to a step S260 where an operation of the fixing unit fluctuation mode B is performed. In the fixing unit fluctuation mode B, the controller 50 allows the fixing unit 80 to fluctuate back and forth at a predetermined speed along the main scanning direction D2 regardless of transporting state of the sheet of paper P, namely, regardless of whether or not the sheet of paper P is nipped between the supporting pressure roller 81 and the outside pressure roller 83 in the fixing unit 80. In this embodiment, such a series of processing is repeated.

As described above, according the second embodiment, since the fixing unit fluctuation mode A or B may be chosen, the fixing unit fluctuation mode may be performed according to a situation of the scratch in the fixing rollers of the fixing unit 80. For example, when the printed sheets of paper P exceeds a predetermined number of the sheets of paper, the fixing rollers are subject to the scratch so that the fixing unit fluctuation mode B in which the fixing unit fluctuation operation has the higher priority is chosen, thereby preventing the scratch from occurring in the fixing rollers. On the other hand, to prevent the sheets of paper P surely from being stacked on the paper-ejection tray 25 with them being irregularly aligned along the main scanning direction D2 the fixing unit fluctuation mode A is chosen.

Third Embodiment

The third embodiment is different from the first or second embodiment in that it is determined to choose the fixing unit fluctuation mode between the fixing unit fluctuation modes A and B based on an interval D between the sheets of transporting paper P. It is to be noted that other components and operations of the image forming apparatus 100 in this embodiment are identical to those of the first, or second embodiment, so that the identical components are indicated by the same reference numbers, a detailed explanation of which will be omitted.

Configuration Example of Image Forming Apparatus According to Third Embodiment The storage unit 64 stores a table in which the species of the sheets of paper and the intervals D between the sheets of transporting paper respectively set corresponding to their sizes and/or species are listed. This is because numbers of the sheets of paper to be printed per minute are previously fixed on the basis of the sizes and/or species thereof so that the intervals D between the sheets of paper are fixed. Of course, a user may set the intervals D between the sheets of transporting paper optionally by using the operation display unit 62. Further, the intervals D between the sheets of paper may be set by detecting a forward end and a rear end of each of the successive sheets of transporting paper P using a sensor and calculating the intervals D by using the detected values.

The storage unit 64 also stores a threshold value Th used as a reference interval when determining whether the operation of the fixing unit fluctuation mode A is performed or the operation of the fixing unit fluctuation mode B is performed. The user may set the threshold value Th optionally using the operation display unit 62. The controller 50 may obtain an optimal value of the threshold value Th automatically from a transporting speed of the sheet of paper P, the interval D between the sheets of paper and a fluctuation speed of the fixing unit 80.

When, for example, the user selects the sheet of desired paper P, the controller 50 reads out of the table the interval D between the sheets of paper corresponding to the size of the sheet of selected paper. The controller 50 then compares the read interval D between the sheets of paper with the previously set threshold value Th. The controller 50 further allows the fixing unit fluctuation mode to be chosen between the fixing unit fluctuation modes A and B and allows the chosen fixing unit fluctuation mode to be performed.

Operation Example of Image Forming Apparatus According to Third Embodiment

Figure 7:
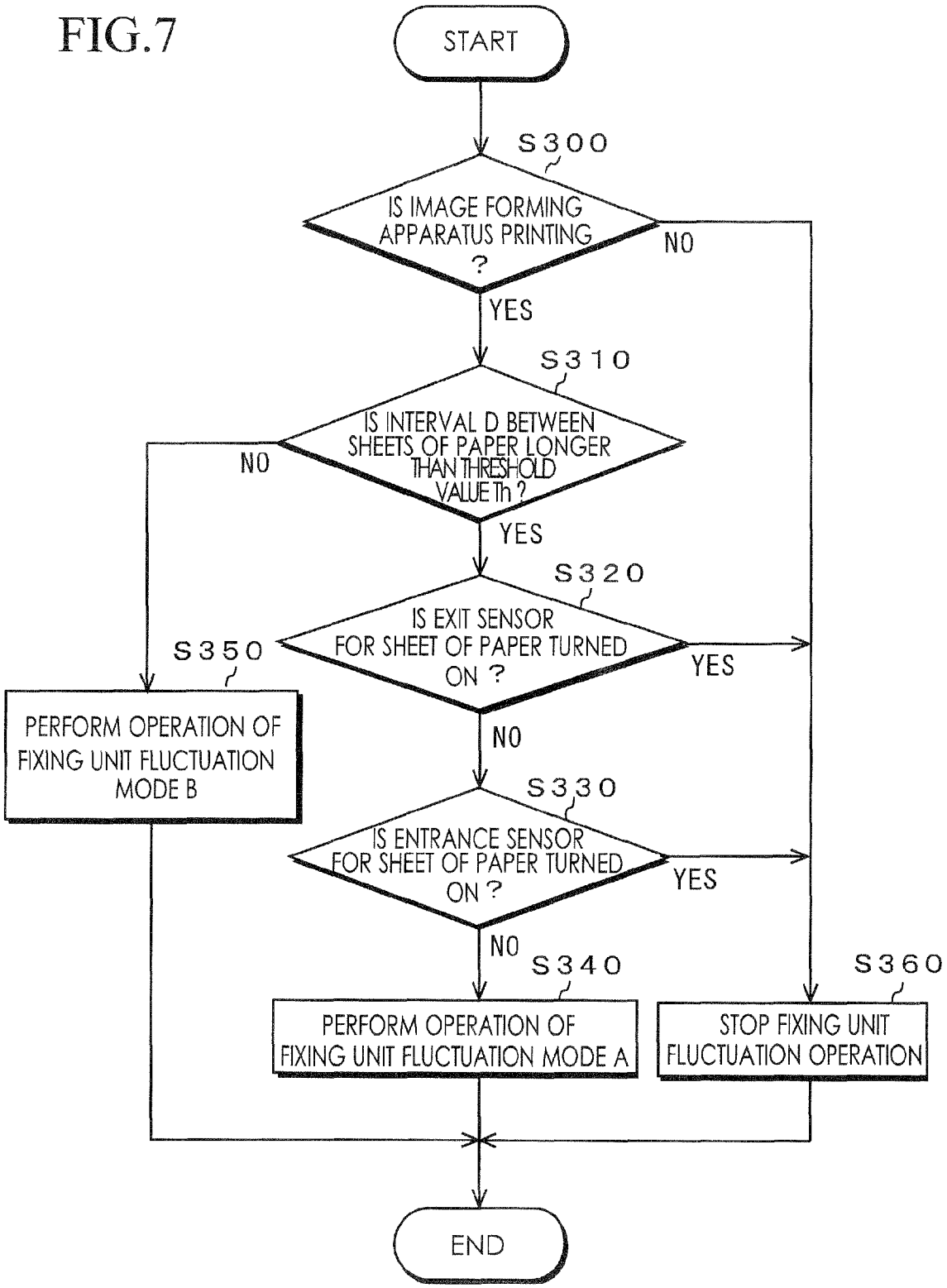
FIG. 7 is a flowchart showing an operation example of the image forming apparatus according to a third embodiment of this invention.

FIG. 7 is a flowchart showing an operation example of the image forming apparatus 100 according to a third embodiment of this invention. As shown in FIG. 7, at a step S300, the controller 50 determines if the image forming apparatus 100 is printing. If the controller 50 determines that the image forming apparatus 100 is printing, then the controller 50 goes to a step S310. If not, then the controller 50 goes to a step S360 where the fixing unit fluctuation operation of the fixing unit 80 is stopped.

At the step S310, the controller 50 determines if the interval D between the sheets of paper in the printing job is longer than the threshold value Th. The controller 50 obtains from the table stored in the storage unit 64 the interval D between the sheets of paper corresponding to, for example, the size of the sheet of paper selected by the user. The controller 50 also obtains the previously set threshold value Th from the storage unity 64. The controller 50 then compares the interval D between the sheets of paper with the threshold value Th. If the controller 50 determines that the interval D between the sheets of paper is longer than the threshold value Th, then the controller 50 goes to a step S320. If the controller 50 determines that the interval D between the sheets of paper is not longer than the threshold value Th, then the controller 50 goes to a step S350.

When the interval D between the sheets of paper is longer than the threshold value Th, at the step S320, the controller 50 determines if an output of the exit sensor 72 for the sheet of paper is turned on. If the exit sensor 72 for the sheet of paper is turned on, the controller 50 determines that the sheet of paper P is nipped between the supporting pressure roller 81 and the outside pressure roller 83 in the fixing unit 80 and goes to the step S360. At the step S360, the controller 50 allows the fixing unit fluctuation operation to be stopped. On the other hand, if the exit sensor 72 for the sheet of paper is turned off, the controller 50 goes to a step S330.

At the step S330, the controller 50 determines if an output of the entrance sensor 70 for the sheet of paper is turned on. If the entrance sensor 70 for the sheet of paper is turned on, the controller 50 determines that the sheet of paper P is nipped between the supporting pressure roller 81 and the outside pressure roller 83 in the fixing unit 80 and goes to the step S360. At the step S360, the controller 50 allows the fixing unit fluctuation operation of the fixing unit 80 to be stopped. On the other hand, if the entrance sensor 70 for the sheet of paper is turned off, the controller 50 determines that the sheet of paper P is not nipped between the supporting pressure roller 81 and the outside pressure roller 83 in the fixing unit 80 because the exit sensor 72 for the sheet of paper is also turned off and goes to a step S340.

At the step S340, because the current sheet of paper P is not being fixed, the controller 50 performs an operation of the fixing unit fluctuation mode A. Specifically, the controller 50 supplies a driving signal to the fixing unit fluctuation motor 91 to be driven so that the fixing unit 80 fluctuates along the main scanning direction D2 at a constant speed.

On the other hand, if the controller 50 determines that the interval D between the sheets of paper is not longer than the threshold value Th at the step S310, the controller 50 goes to the step S350 where an operation of the fixing unit fluctuation mode B is performed. This is because if the interval D between the sheets of paper is short, there may be a case where the fixing unit 80 cannot fluctuate by a distance which is sufficient for prevent the scratch from occurring in the fixing rollers so that any effect by the fluctuation of the fixing unit is not obtained. Therefore, in the fixing unit fluctuation mode B, the controller 50 allows the fixing unit 80 to fluctuate back and forth at a predetermined speed along the main scanning direction D2 regardless of whether or not the sheet of paper P is nipped between the supporting pressure roller 81 and the outside pressure roller 83 in the fixing unit 80. In this embodiment, such a series of processing is repeated.

As described above, according the third embodiment, since the fixing unit fluctuation mode A is performed when the interval between the sheets of paper is longer than the threshold value Th, the controller 50 enables the fixing unit 80 to fluctuate by a distance, which is sufficient for preventing the scratch from occurring in the fixing rollers, within the interval D between the sheets of paper. Accordingly, it is possible to prevent the scratch from occurring in the fixing rollers due to a fact that the sheets of paper pass through the same location therein and to stack the sheets of paper P on the paper-ejection tray 25 without being irregularly aligned along the main scanning direction D2

Fourth Embodiment

The fourth embodiment is different from the third embodiment in that it is determined to choose the fixing unit fluctuation mode between the fixing unit fluctuation modes A and B based on an interval D between the sheets of transporting paper P and in the fixing unit fluctuation modes A and B, their fluctuation speeds (their fixing unit fluctuation operations) are different from each other. It is to be noted that other components and operations of the image forming apparatus 100 in this embodiment are identical to those of each of the first through third embodiments so that the identical components are indicated by the same reference numbers, a detailed explanation of which will be omitted.

Configuration Example of Image Forming Apparatus According to Fourth Embodiment The controller 50 sets the fixing unit fluctuation speed of the fixing unit 80 so as to be a fluctuation speed M when setting the fixing unit fluctuation mode A as the fixing unit fluctuation mode. The controller 50 also sets the fixing unit fluctuation speed of the fixing unit 80 so as to be a fluctuation speed N when setting the fixing unit fluctuation mode B as the fixing unit fluctuation mode. The fixing unity fluctuation speed N of the fixing unit 80 is a slow speed, for example, about several hundreds μm/s so that it has no influence on the fixing processing. The fixing unit fluctuation speed M of the fixing unit 80 is faster than the fixing unit fluctuation speed N of the fixing unit 80 and is set to be a speed such that any color shifts or the like of the toner images do not occur during the fixing processing. A user may set the fixing unit fluctuation speed M optionally using the operation display unit 62. The controller 50 may calculate an optimal value of the fixing unit fluctuation speed M automatically from the transporting speed of the sheets of paper P, the interval D between the sheets of transporting paper, the fixing unity fluctuation speed N of the fixing unit 80 and the like. The ROM of the controller 50 and/or the storage unit 64 store(s) such fixing unit fluctuation speeds M, N with them respectively corresponding to the fixing unit fluctuation modes A and B.

Operation Example of Image Forming Apparatus According to Fourth Embodiment

Figure 8:
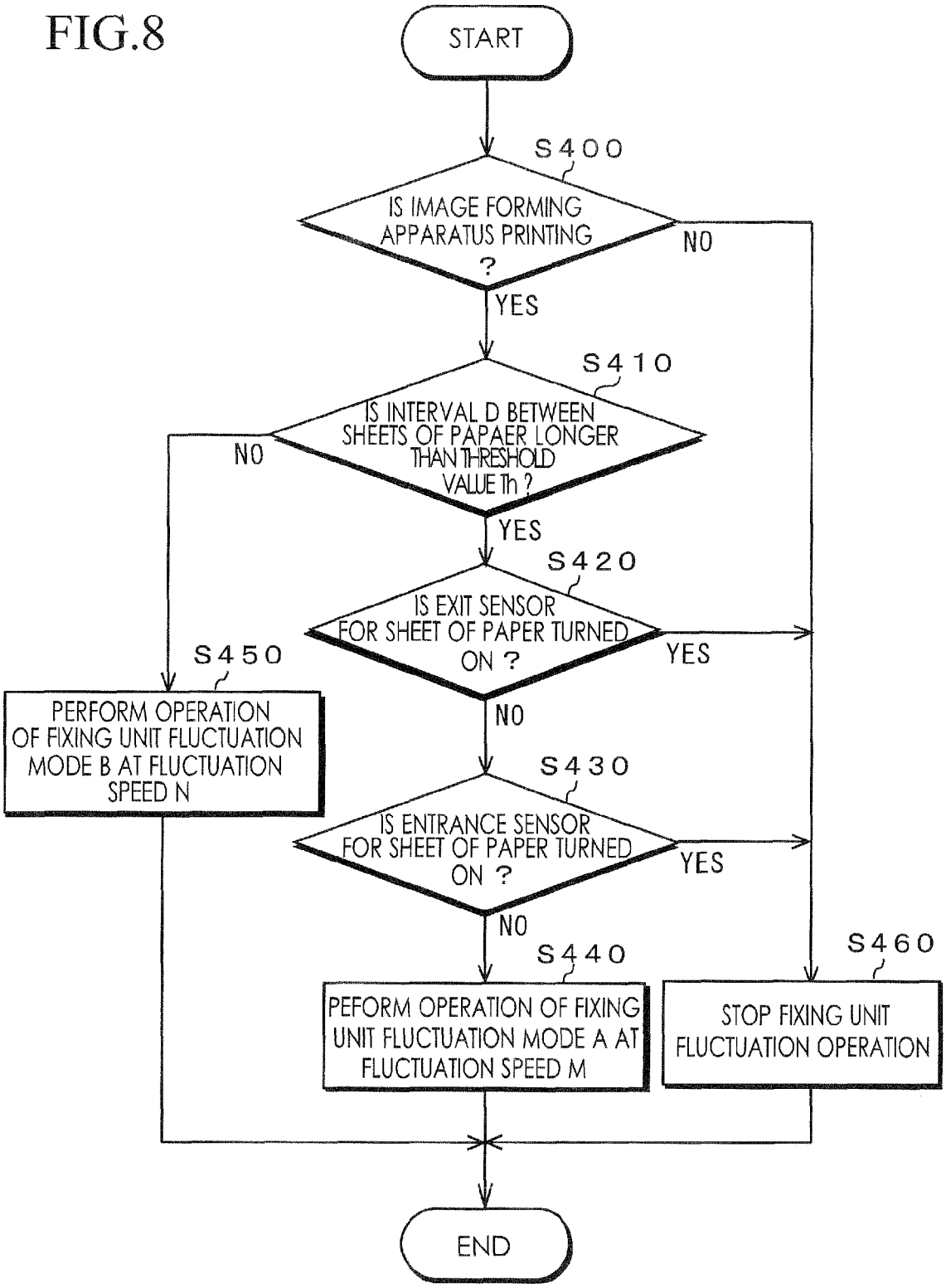
FIG. 8 is a flowchart showing an operation example of the image forming apparatus according to a fourth embodiment of this invention.

FIG. 8 is a flowchart showing an operation example of the image forming apparatus 100 according to a fourth embodiment of this invention. It is to be noted that the operations except for steps S440 and S450 are the same as those of the steps S300 through S330, and S360 shown in FIG. 7 of the third embodiment so that these operations will be simply described.

As shown in FIG. 8, at a step S400, the controller 50 determines if the image forming apparatus 100 is printing. If the controller 50 determines that the image forming apparatus 100 is printing, then the controller 50 goes to a step S410. If not, then the controller 50 goes to a step S460 when the fixing unit fluctuation operation of the fixing unit 80 is stopped.

At, the step S410, the controller 50 determines if the interval D between the sheets of transporting paper in the printing job is longer than the threshold value Th. If the controller 50 determines that the interval D between the sheets of transporting paper is longer than the threshold value Th, then the controller 50 goes to a step S420. If the controller 50 determines that the interval D between the sheets of transporting paper is not longer than the threshold value Th, then the controller 50 goes to a step S450.

When the interval D between the sheets of transporting paper is longer than the threshold value Th, at the step S420, the controller 50 determines if the exit sensor 72 for the sheet of paper is turned on. If the exit sensor 72 for the sheet of paper is turned on, then the controller 50 goes to the step S460 where the fixing unit fluctuation operation of the fixing unit 80 is stopped. On the ether hand, if the exit sensor 72 for the sheet of paper is turned off, the controller 50 goes to a step S430.

At the step S430, the controller 50 determines if the entrance sensor 70 for the sheet of paper is turned on. If the entrance sensor 70 for the sheet of paper is turned on, the controller 50 goes to the step S460 where the fixing unit fluctuation operation of the fixing unit 80 is stopped. On the other hand, if the entrance sensor 70 for the sheet of paper is turned off, the controller 50 goes to a step S440.

At the step S440, the controller 50 performs an operation of the fixing unit fluctuation mode A at the fixing unit fluctuation speed. M. The controller 50 controls the fixing unit fluctuation motor 91 to drive and allows the fixing unit 80 to fluctuate along the main scanning direction D2 at the fluctuation speed M which is faster than the normal fluctuation speed N. This enables the supporting pressure roller 81, the outside pressure roller 83 and the like to fluctuate by an amount of movement more than that of the normal fluctuation along the main scanning direction D2, thereby preventing the scratch from occurring in the fixing rollers due to a fact that the sheets of paper P pass through the same location therein.

On the other hand, if the controller 50 determines that toe interval. D between the sheets of transporting paper is not longer than the threshold value Th at the step S410, the controller 50 goes to the step S450 where an operation of the fixing unit fluctuation mode B is performed at the fixing unit fluctuation speed N. The controller 50 controls the fixing unit fluctuation motor 91 to drive and allows the fixing unit 80 to fluctuate along the main scanning direction D2 at the fixing unit fluctuation speed N that is a reference fluctuation speed. In this embodiment, such a series of processing is repeatedly performed.

As described above, according the fourth embodiment, since the operation of the fixing unit fluctuation mode A is performed so that it is faster than the operation of the fixing unit fluctuation mode B, the much amount of fluctuation distance of the fixing unit 80 may be obtained even in the fixing unit fluctuation mode A within the interval between the sheets of transporting paper P. Accordingly, it is possible to prevent the scratch from occurring in the fixing rollers more surely, in addition to the excellent effects of the above-mentioned first through third embodiments.

This invention is applicable to the image forming apparatus which is capable of correcting the positional deflection of the sheet of transporting paper with high accuracy.

Although the present invention has been described with reference to the embodiments above, it is to be noted that the present invention is not, limited to the embodiments, and various changes and modifications are possible to those who are skilled in the art insofar as they are within the scope of the invention. Although in the above-mentioned embodiments, it has been determined whether or not the sheet of paper P is nipped between the fixing rollers based on an output result of a pair of the entrance sensor 70 for the sheet of paper and the exit sensor 72 for the sheet of paper, the present invention is not limited thereto. For example, it may be determined whether or not the sheet of paper P is nipped between the supporting pressure roller 81 and the outside pressure roller 83 (the fixing rollers) by using one output result of a sensor positioned upstream from the fixing unit 80 along the transporting direction of the sheet of paper P and calculating a period of time until the sheet of paper P reaches the fixing unit 80. The controller 50 calculates the period of time from a point of time when the sensor detects the sheet of paper P to a point of time when the sheet of paper P reaches the fixing unit 80 based on a detection result of the sheet of paper P by the sensor, a transporting distance of the sheet of paper P between this sensor and the fixing unit 80, a transporting speed of the sheet of paper P. The controller 50 controls the fixing unit fluctuation motor 91 to drive so that the fixing unit 80 stops fluctuating at the point of time when the sheet of paper P reaches the fixing unit 80. As the sensor, for example, the entrance sensor 70 for the sheet of paper, the deviation detection sensor 68 and a sensor positioned at the feeder can be used. Under such a process, it is possible to prevent the sheets of paper P from being stacked on the paper-ejection tray 25 with them being irregularly aligned along the main scanning direction D2 like the above-mentioned embodiments. Further, since it is determined whether or not the sheet of paper P is nipped between the fixing rollers of the fixing unit 80 by using one sensor, the image forming apparatus may result in a reduction of costs thereof.

It should be understood by those skilled in the art that carious modifications, combinations, sub-combinations and alterations may occur depending on design requirements and other factors insofar as they are within the scope of the appended claims or the equivalents thereof.

What is claimed is:

1. An image forming apparatus that forms an image on a sheet of paper, the apparatus comprising:

an adjustment unit that adjusts an image transfer position of the sheet of paper along a main scanning direction that is orthogonal to a transporting direction of the sheet of paper;

a transferring unit that transfers a toner image at the image transfer position on the sheet of paper, the image transfer position of the sheet of paper having been adjusted by the adjustment unit;

a fixing unit that (i) fixes on the sheet of paper the toner image transferred on the sheet of paper by the transferring unit using fixing rollers to heat and press the toner image on the sheet of paper and (ii) performs a fluctuation of the fixing rollers along the main scanning direction;

a detection unit that detects whether or not the fixing rollers of the fixing unit nip the sheet of paper; and a control unit that controls the fixing unit to perform the fluctuation of the fixing rollers when determining that the fixing rollers of the fixing unit do not nip the sheet of paper based on a detection result of the detection unit;

wherein:

the control unit determines whether or not an interval between the sheets of transported paper is longer than a reference interval which has been previously set;

if the interval between the sheets of transported paper is longer than the reference interval, the control unit controls the fixing unit to perform the fluctuation of the fixing rollers when the fixing rollers of the fixing unit do not nip the sheet of paper; and if the interval between the sheets of transported paper is not longer than the reference interval, the control unit controls the fixing unit to perform the fluctuation of the fixing rollers regardless of whether or not the fixing rollers of the fixing unit nip the sheet of paper.

2. The image forming apparatus according to claim 1, further comprising an operation unit that accepts an input operation to set the fixing unit so as to perform the fluctuation of the fixing rollers when the fixing rollers of the fixing unit do not nip the sheet of paper, or to perform the fluctuation of the fixing rollers regardless of whether or not the fixing rollers of the fixing unit nip the sheet of paper.

3. The image forming apparatus according to claim 1, wherein the control unit controls the fixing unit to perform the fluctuation of the fixing rollers at a first speed when the interval between the sheets of transported paper is not longer than the reference interval, and the control unit controls the fixing unit to perform the fluctuation of the fixing rollers at a second speed which is faster than the first speed when the interval between the sheets of transported paper is longer than the reference interval.

4. The image forming apparatus according to claim 1, wherein the adjustment unit adjusts the image transfer position based on a center of a transporting path of the sheet of paper.

5. The image forming apparatus according to claim 1, wherein the adjustment unit adjusts the image transfer position based on one side of an image forming position.

6. The image forming apparatus according to claim 1, further comprising an image forming unit, wherein the detection unit comprises:

a first sensor that detects each of the sheets of paper transported from the image forming unit, the first sensor being positioned at an entrance side of the fixing unit; and a second sensor that detects each of the sheets of paper on which the fixing unit performs fixing processing, the second sensor being positioned at an exit side of the fixing unit, and wherein the control unit controls the fixing unit to perform the fluctuation of the fixing rollers when the first and second sensors do not detect any of the sheets of paper.

* * * * *